United States Patent [19]

Stenerud

[11] 4,418,910

[45] Dec. 6, 1983

[54] FOOTBALL KICKING TEE

[75] Inventor: Jan Stenerud, Overland Park, Kans.

[73] Assignee: Jan Stenerud and Company, Inc., Shawnee Mission, Kans.

[21] Appl. No.: 370,782

[22] Filed: Apr. 23, 1982

Related U.S. Application Data

[63] Continuation-in-part of Ser. No. 234,425, Feb. 13, 1981, abandoned.

[51] Int. Cl.[3] ..... A63B 67/00

[52] U.S. Cl. ..... 273/55 B

[58] Field of Search ..... 273/55 R, 55 B; D21/29

[56] References Cited

U.S. PATENT DOCUMENTS

| | | | |
|---|---|---|---|
| D. 150,195 | 7/1948 | Barton | 273/55 B |
| D. 195,088 | 4/1963 | Box . | |
| D. 202,433 | 9/1965 | Cullity . | |
| D. 231,002 | 3/1974 | Ponder . | |
| 2,659,604 | 11/1953 | McGowan . | |
| 3,309,087 | 3/1967 | Cullity | 273/55 B |
| 3,481,602 | 12/1969 | Tatter . | |
| 3,516,667 | 6/1970 | Williams . | |
| 3,804,409 | 4/1974 | Schachner | 273/55 B |
| 4,019,735 | 4/1977 | Thompson | 273/55 B |

*Primary Examiner*—Richard C. Pinkham
*Assistant Examiner*—T. Brown
*Attorney, Agent, or Firm*—Schmidt, Johnson, Hovey & Williams

[57] ABSTRACT

A football kicking tee is disclosed which is especially useful by soccer style kickers wherein a horizontal ball supporting platform has three depending legs that support the tee above the football turf at a desired height, two upright elements and a third upright member at the rear of the tee platform strategically located to engage the sidewall of the football and hold it upright until kicked even under relatively windy conditions. The rear support elements are positioned along an imaginary line therebetween which is at an angle to an imaginary fore and aft line bisecting the platform and parallel to the intended flight path of the ball. As a result, there is minimal, if any, contact of the upper instep of the kicker's foot with the support elements as the kicker's foot moves into impacting engagement with the upright football. The tee is useful for kick-off practice and game kick-offs as well as field goals or field goal practice.

21 Claims, 14 Drawing Figures

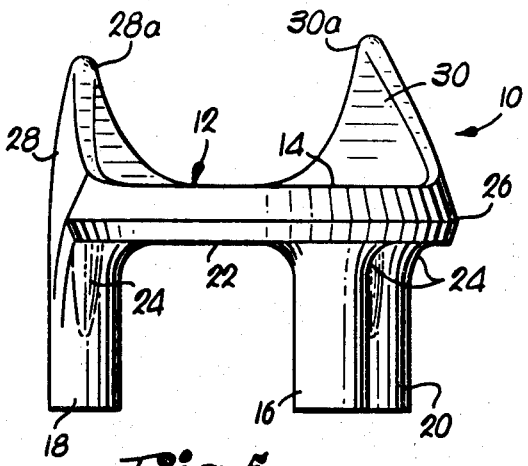
Fig.5.
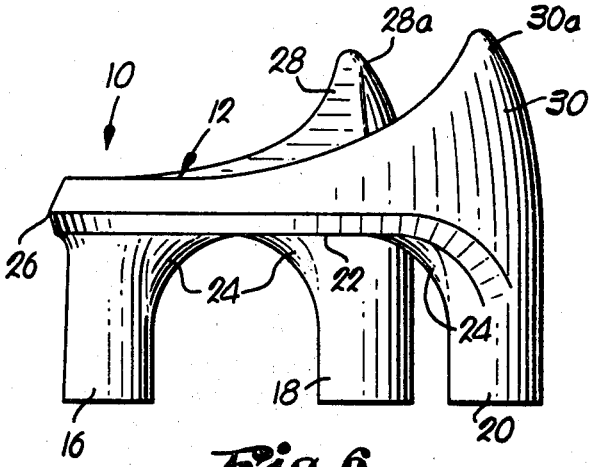
Fig.6.
Fig.7.
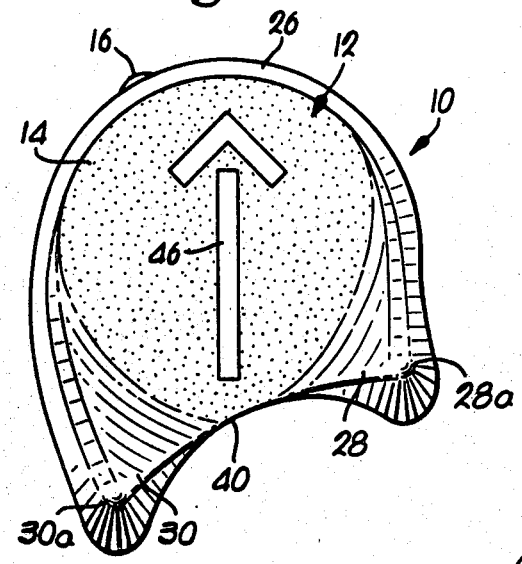
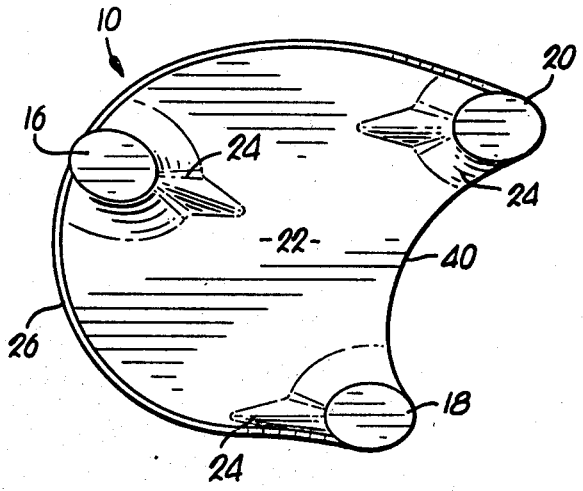
Fig.8.
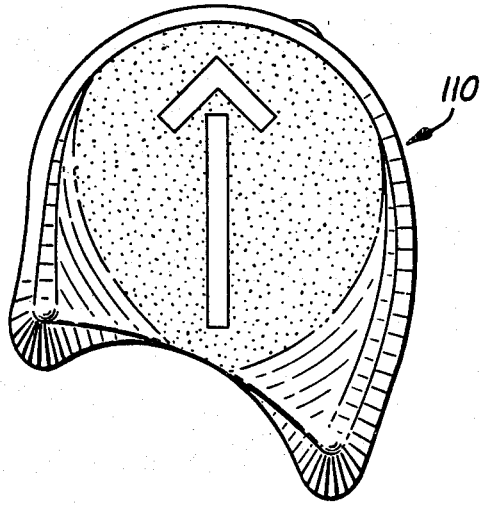
Fig.9.

FOOTBALL KICKING TEE

RELATED APPLICATION

This is a continuation-in-part application of my application, Ser. No. 234,425, filed Feb. 13, 1981 (abandoned) of the same title.

BACKGROUND OF THE INVENTION

1. Field of the Invention

This invention relates to football kicking tees of the type which are used for support of a ball for kickoffs and/or field goals and practice thereof and have particular utility for soccer style kicking without sacrifice in distance accuracy while providing increased accuracy and avoiding the foot injury problems that have plagued soccer style kickers during field goal practice.

2. Description of the Prior Art

Kickoff tees now available at all levels of competition from prep school through the professional organizations have all been fabricated for point of the toe impact of the kicker's foot with the football as the foot is swung through a straight ahead arc in the intended direction of the kick. A particularly exemplary tee in this respect is illustrated in Box, U.S. Pat. No. D195,088 of Apr. 23, 1963 and still represents the present state of the commercial art. In the Box tee, the kicker's toe moves between the two rearmost supports of the tee with little, if any, engagement of the foot with the tee until after the kicker has impacted the ball and sent it along its flight trajectory.

A soccer style kicker approaches the ball at an angle from the rear and kicks it with the upper instep of his foot between the toe and ankle. Soccer style kicking has grown in popularity because of the control the kicker has of the ball and the greater height and distance which can be achieved. By virtue of the fact that body torque enters into the leg swing, greater force can be transmitted to the ball than is the case with straight ahead, point of the toe kicking. The difference can be somewhat likened to a golf swing. A golfer coils his body during the backswing and in the course of swinging the club uncoils his body in coordinated relationship to club travel to put body weight along with arm swing into the ball hit. Soccer style kicking of a football is somewhat similar in that the kicker coils his body to a certain extent during approach to the ball and then uncoils in the opposite direction in timed coordination with the swing of his kicking leg to impart greater force to the ball. Soccer style kickers are also believed to get slower end-to-end spin on their kicks allowing the ball to travel a greater distance.

Although kicking tees are used under game conditions for kickoffs and on a high school level for field goals, they are also universally employed by kickers, including soccer style kickers for field goal practice since timing is an all important aspect of the kicking rhythm. This necessarily takes long, consistent practice. However, when a soccer style kicker practices kickoffs and field goals with a conventional tee such as that depicted in the Box U.S. Pat. No. D195,088, the upper instep of his foot tends to contact one or both of the rear ball support elements before engagement with the ball. Two results occur. First, contact of the foot with the tee before ball engagement can have an effect on distance as well as direction, noting in this respect that a small angular error at the kicking site can have a significant affect at the end of the ball's trajectory—some distance down the field.

The additional known prior art of kicking tees includes a block like base as shown in the U.S. Pat. No. 2,659,604 wherein the football is supported in a V-shaped valley; but here again, the design is for straight ahead kickers—not soccer style kickers. The tee of U.S. Pat. No. 3,309,087 is similar in material respect to the above-referenced Box tee in that it has two rear upright ball supports located for the kicker's toe to go therebetween in straight ahead fashion. U.S. Pat. No. 3,481,602 discloses a fold-up tee that has more than one specific patented use, i.e. kickoffs as well as field goals under game conditions. Here again though, the two rear football supports are transversely aligned and located for point of toe, straight ahead engagement of the kicker's foot with the ball.

The only prior art patent known that discusses soccer style kicking at all is U.S. Pat. No. 3,516,667, but even in this instance, the two upright supports for the ball of the U or V-shaped devices are described as being spaced for "free passage of the kicker's foot," therebetween.

SUMMARY OF THE INVENTION

An important object of this invention is to provide a kicking tee that may be made available at a reasonable cost and although useable by all types of kicker, is especially adapted for use by soccer style kickers to enhance the distance and accuracy of their kicks without attendant foot injury problems that have been prevalent in the use of tees designed for point of toe, straight ahead kickers.

An especially significant aim of the invention is to provide a kicking tee for use by soccer style kickers wherein the platform for receiving the toe portion of the football to be kicked is supported above ground level by strategically located, triangle defining leges and wherein structure projecting upwardly from the platform located to engage the side wall of a football to maintain the latter in the desired upright position, is located substantially along an imaginary line in generally parallel relationship to the side of the kicker's foot so that there is little, if any, contact with his upper instep with the tee prior to engagement with the ball. This minimizes inaccurate kicks, contributes to distance, and allows the kicker to practice at length without his foot becoming sore by virtue of repeated contact of the upper instep with the rear upright support elements of the tee.

Another particularly important object of the invention is to provide a soccer style kicking tee as described wherein a third upright member is provided at the rear portion of the tee platform for stabilizing the ball as it is supported on the tee platform to prevent deflection of the ball before being impacted by the kicker's foot.

A further important object of the invention is to provide a kicking tee as described wherein indicia in the nature of an arrow is placed on the ball support platform and pointing toward the intended direction of flight of the ball so that the kicker may more accurately position the tee during ball placement thereon.

A still further important object of the invention is to provide a football kicking tee which allows the user to support a ball thereon at different upright inclinations to control the trajectory of the ball, all without significant contact of the kicker's instep with the tee before engagement with the football.

Other important objects and aims of the invention will become obvious or be explained in detail as the following specification progresses.

BRIEF DESCRIPTION OF THE DRAWINGS

FIG. 5 is an enlarged front elevational view of the kicking tee of the preceding Figures;

FIG. 6 is a side elevational view on the same scale as FIG. 5 and showing the side thereof opposite that illustrated in FIG. 1;

FIG. 7 is a top plan view of the kicking tee as illustrated in FIGS. 5 and 6;

FIG. 8 is a bottom view of the kicking tee previously described;

FIG. 9 is a plan view of an alternate embodiment of the kicking tee shown in preceding drawings, and especially adapted in this instance for use by left footed kickers.

DESCRIPTION OF A FIRST EMBODIMENT OF THE INVENTION

Figure 2:
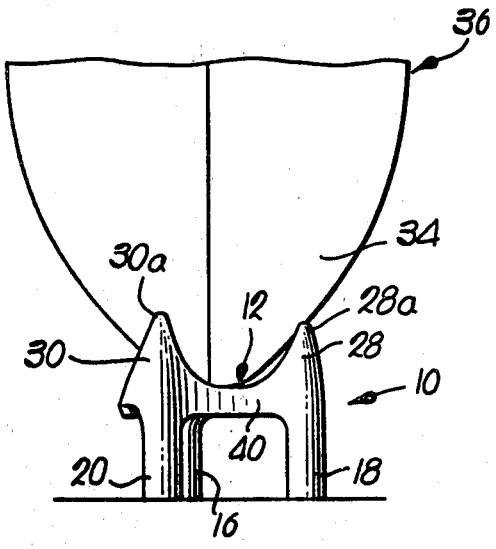
FIG. 2 is a rear elevational view of the kicking tee shown in FIG. 1 and again depicting the way in which a football is normally supported thereon.

The kicking tee broadly designated by the numeral 10 in FIGS. 1–8 inclusive is especially adapted for use by right footed, soccer style kickers. The kicking tee 110 of FIG. 9 on the other hand is especially useful by left footed soccer style kickers. (The preferred embodiment of the invention shown in FIGS. 10–14 and designated 210 also is especially for right footed kickers but can be fabricated for left footed kickers in the same general configuration as tee 110.)

Directing attention initially to the embodiment of FIGS. 1–8 inclusive, tee 10 has a main horizontal platform 12 having an essentially flat upper face 14 of somewhat oval configuration. Three legs 16, 18 and 20 depend from the lower surface 22 of platform 12 and present a substantially triangular pattern to enhance the stability of tee 10 on surfaces of varying texture and uniformity. Viewing FIG. 8, it can be seen that the forwardmost leg 16 is located to one side of a fore and aft line through the center of the tee 10 while leg 18 is positioned somewhat forwardly of the rearmost leg 20. In all instances, the legs 16–20 inclusive are of transversely oval configuration with the longitudinal axes thereof extending in the direction of intended path of flight of the ball to increase the stability of the tee in the direction of impact while minimizing its overall weight. Also as can be seen in FIGS. 5, 6 and 8, the normally uppermost extremities of each of the legs 16–20 merge smoothly into the lower surface 22 of platform 12 in the nature of reinforcing filets 24.

The outer beveled edge 26 of platform 12 is of generally horseshoe shaped configuration as best depicted in FIGS. 7 and 8 and extends from the rearmost leg 20 around the circumference of the tee and joins smoothly with the intermediate rear support leg 18. As shown, the legs are intended to support the upper face 14 of platform 12 two inches above ground level. However, it is to be understood that the height of legs 16–20 may be varied depending upon the particular rules for the tee which is legal at the level of play of the kicker. For example, professional rules now allow a kicking tee wherein the support platform is 3 inches above the field while college rules provide for only a 2 inch lift of the ball off of the ground. The forwardmost portion of platform 12 is numerated 25 while the rearmost portion thereof has been designated 27.

Two rear support elements 28 and 30 project upwardly from the rear portion 27 of platform 21 at the rearmost extremity thereof and each is of somewhat three-dimensionally triangular configuration as best shown in FIGS. 5 and 6 to provide upper apex or tip portions **28*a* and 20*a* respectively which are canted slightly forwardly and toward each other as indicated in FIGS. 5 and 6 for essentially point contact with the side wall 34 of a conventional football 36. Each of the support elements 28 and 30 also has filet sections which merge smoothly into the upper face 14 and beveled edge 26 of platform 12. The inner triangular faces 28*b* of element 28 and 30*b* of element 30 are of generally concave somewhat dished-shaped configuration. It can be seen from FIG. 3 that the elements 28 and 30 are on opposite sides of an imaginary fore and aft line bisecting platform 14** and parallel to the intended flight path of the ball.

Figure 1:
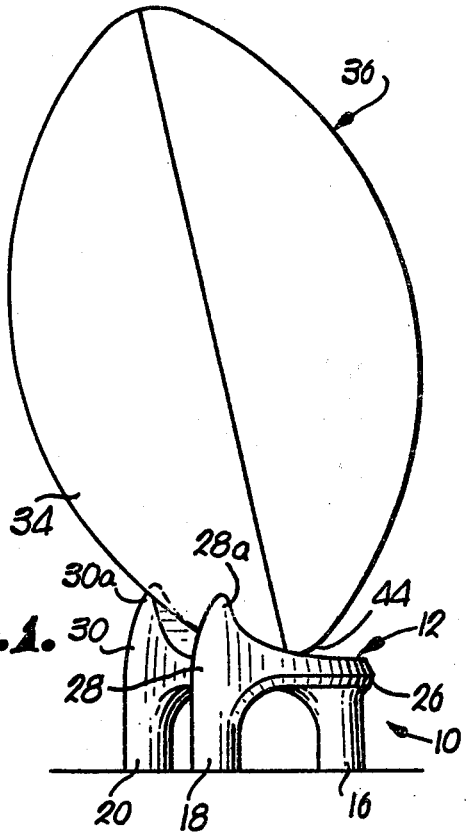
FIG. 1 is a side elevational view of one embodiment of a kicking tee made in accordance with this invention and showing the way in which the same is adapted to support a football in an upright, somewhat inclined, normal kicking disposition.
Figure 3:
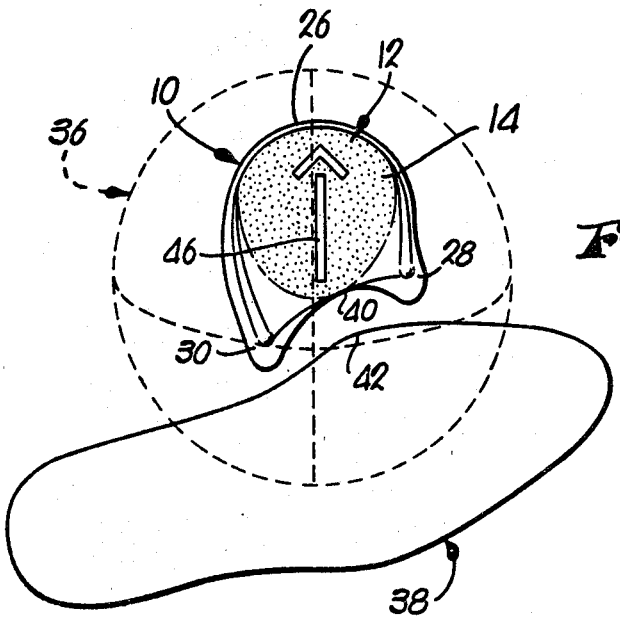
FIG. 3 is a plan view of the kicking tee previously described and showing the football supported thereon in dashed lines, while the normal relationship of the foot of a soccer style kicker to the ball immediately prior to impact of the kicker's instep with the lower part of the ball is illustrated by diagrammatic full line depiction.

Viewing FIGS. 1, 2 and 5 particularly, it can be seen that the support element 30 is of slightly greater height than the associated support element 28. This difference in height is preferred although not absolutely essential to allow the instep portion 36 of the kicker's foot 38 (FIG. 3) to engage the side wall of 34 of football 36 before contacting either of the support elements 28 or 30 during the swing of the kicker's foot. Also as best shown in FIGS. 7 and 8, the rearmost edge surface 40 of platform 12 is of concave configuration inside of a straight line between the points **28*a* and 30*a* respectively of support elements 28 to clear the ball portion 42 of the kicker's foot 38 (again referring to FIG. 3**).

The upper face 14 of platform 12 preferably has a textured surface as indicated schematically by the stippling and this may take the form of a series of parallel grooves, a plurality of raised, spaced cylinders presenting a textured face, or a roughened configuration which provides frictional engagement of the toe portion 44 of football 36 with the tee platform 12.

Directional indicia in the form of an arrow 46 is also provided in the upper face 14 of tee 10 as best shown in FIG. 7 and it is noteworthy that such arrow bisects the space between support elements 28 and 30 and is to the right of leg 16 looking down on top of the tee. The arrow 46 allows the kicker to accurately position the tee during placement of football 36 thereon for maximum accuracy.

Although tee 10 may be manufactured of various materials, it is particularly contemplated that it be molded in one piece of a suitable synthetic resin material that has adequate abrasion resistence for rough usage, but yet of a durometer that repeated engagement of the instep 36 of the kicker's foot with the tee 10 will not cause injury to the kicker's foot.

It is to be pointed out that the space between elements 28 and 30 is insufficient to allow a kicker's foot to pass therebetween and such space is less than the widest area of a kicker's foot. In a typical embodiment of tee 10, the distance between the tips or apices of elements 28 and 30 is no more than about 3 inches. Similarly, the face 14 of the platform has a diameter of approximately 3 inches. Element 28 is approximately 1⅜ inches high and element 30 about 1½ inches in height. The total front to rear dimension of the tee is about 4½ inches and the width about 3¾ inches. Element 28 is about 1½ inches forwardly of element 30.

In use, the kicker places tee 10 on the ground using arrow 46 for proper orientation and the football is then located in disposition as illustrated in FIGS. 1 and 2 with the toe 44 resting on face 14 of platform 12 while the side wall 34 of the football 36 is supported by elements 28 and 30. The kicker may cant the football 36 as much as desired and the textured surface of face 14 assists in causing the ball to stay in its intended position. Similarly, if desired, the player may tilt the football to one side or the other for particular effects and to impart different degrees of spiraling to the football as it is kicked from the tee. Here again, the arrow 46 assists in offsetting of the football to a desired degree from normal upright disposition, noting in this respect that when it is desired to place the football in a truly upright although slightly canted position, the player need only place the toe 44 of football 36 directly on the longitudinal axis of arrow 46.

Figure 4:
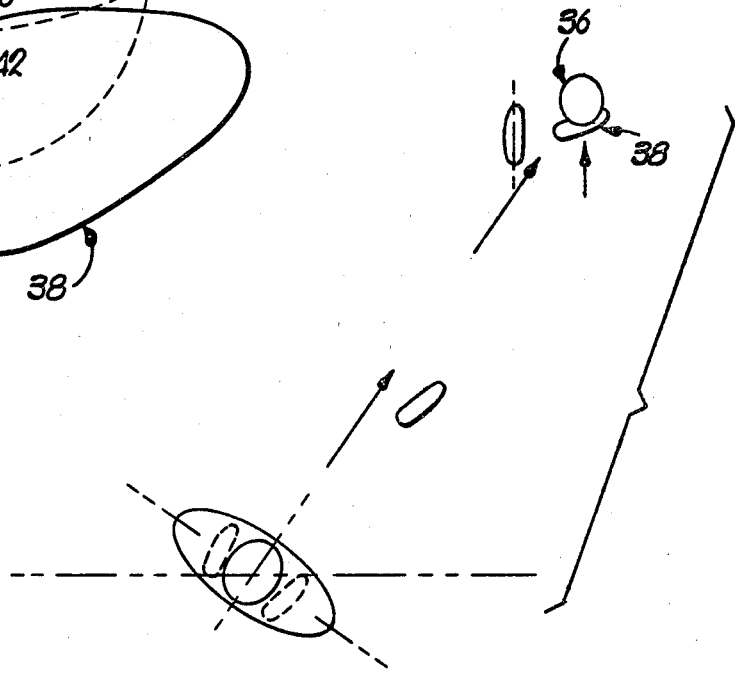
FIG. 4 is a schematic representation of the way in which one form of kicking tee of this invention may be used to practice field goals for example, and showing the step pattern of the kicker toward and then finally engaging the ball to propel the same down the field.

A schematic representation of the way in which a soccer style kicker approaches a football 36 to be kicked is shown in FIG. 4 and it can be seen that at the time of impact of the player's right foot with the ball, the foot is at an angle relative thereto so that the upper instep of the foot actually engages the under sidewall of the ball. The construction and configuration of tee 10 is especially suited to provide the most accurate kick with the longest trajectory by virtue of the fact that the kicker's instep 42 contacts only the under sidewall 34 of the football 36 before engaging any of the tee support structure which could cause the ball to be deflected from its intended path. Similarly, the forwardly canted support elements 28 and 30 as best shown in FIGS. 1 and 6 provides clearance for the kicker's foot until it contacts the football, and at the same time serves as surfaces which cause the foot to be deflected forwardly over the top of the tee with only a glancing blow at most thus minimizing the impact force of the player's foot with the tee which could cause injury, recalling in this respect that the upper instep of a foot is relatively prone to bruising since there is very little tissue between the player's skin and the underlying bone.

The tee 10 is also unusually stable by virtue of offsetting of the front leg 16 relative to the longitudinal axis of the tee as, for example, defined by arrow 46 in that when the kicker's foot 38 comes across the tee at an angle as is apparent from FIG. 4, the leg 16 is located in disposition to stabilize the tee from tipping, notwithstanding the fact that an angular force is being placed thereon during kicking of the football, and again maximizing both the accuracy and the distance of the kick.

In tee embodiment 10 illustrated in FIGS. 1–8 of the drawings, an imaginary line between the tips **28*a* and 30*a* of elements 28 and 30 is at an angle of about 25° with respect to the longitudinal axis of arrow 46**. However, this angle may be varied as desired to somewhat greater than 0° to over 45°. Best results are obtained though when the angle is maintained within the range of about 15° to about 35°.

The alternate embodiment of the invention illustrated in FIG. 9 is simply a mirror image of the tee depicted in FIGS. 1–8 inclusive and therefore need not be described in detail. Suffice it to say that the tee 110 is especially useful by left footed kickers with all the benefits of the tee 10 being equally applicable to tee 110.

PREFERRED EMBODIMENT OF THE INVENTION

The preferred embodiment 210 of the invention as illustrated in FIGS. 10–14 has all of the constructional features and attributes of embodiments 10 and 110 and therefore to the extent the structures are the same, the elements need not and will not be described again since a comparison of the drawings readily reveals the similarities. As a result, it is intended that the structural description and operational explanation previously given relative to tee 10 and 110 are fully applicable to the same components of tee 210. Such description and explanation of operation and use of the tee will not be repeated as being directly applicable hereto by reference thereto.

Figure 10:
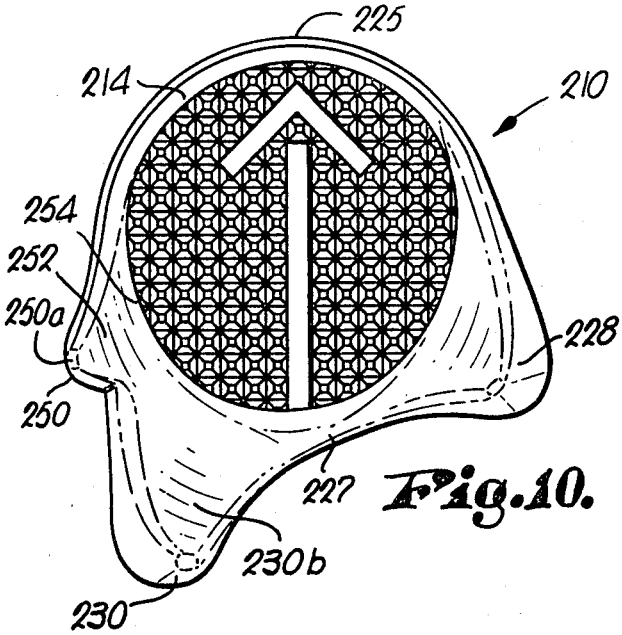
FIG. 10 is a plan view of a preferred embodiment of the soccer style kicking tee of this invention.
Figure 11:
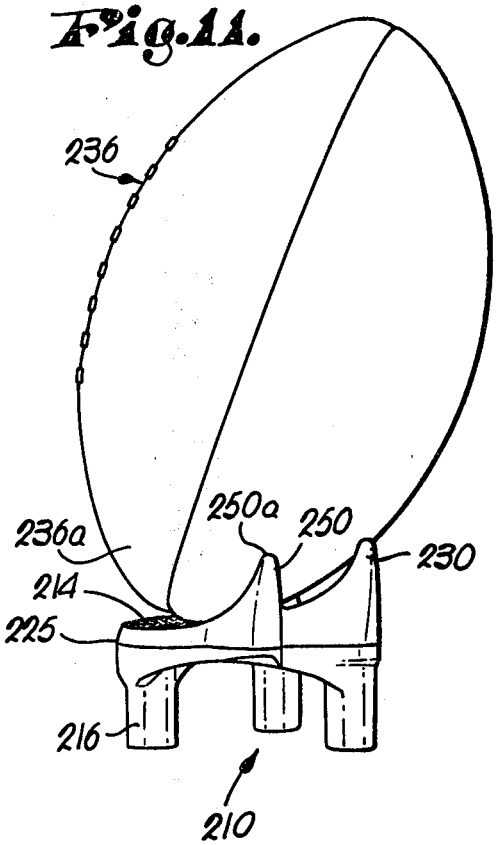
FIG. 11 is a side elevational view from the left side and on a reduced scale of the tee of FIG. 11 and illustrating how a third football support member projecting upwardly from the ball platform assists in stabilizing the ball against deflection by wind currents blowing toward the tee from the right side thereof.
Figure 12:
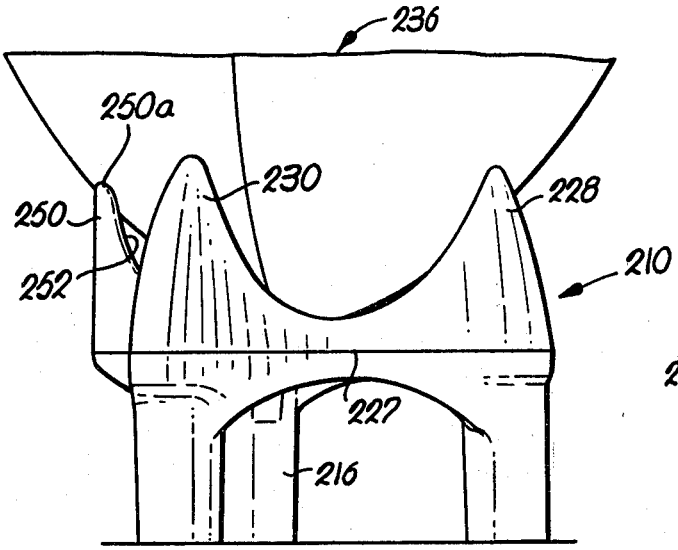
FIG. 12 is a rear elevational view of the tee as depicted in FIGS. 11 and 12.
Figure 13:
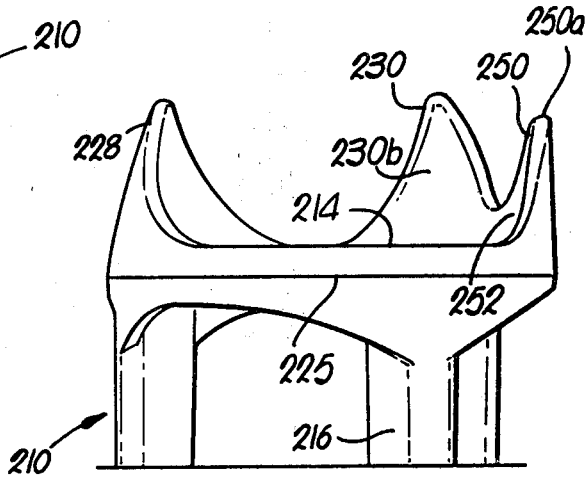
FIG. 13 is a front elevational view.
Figure 14:
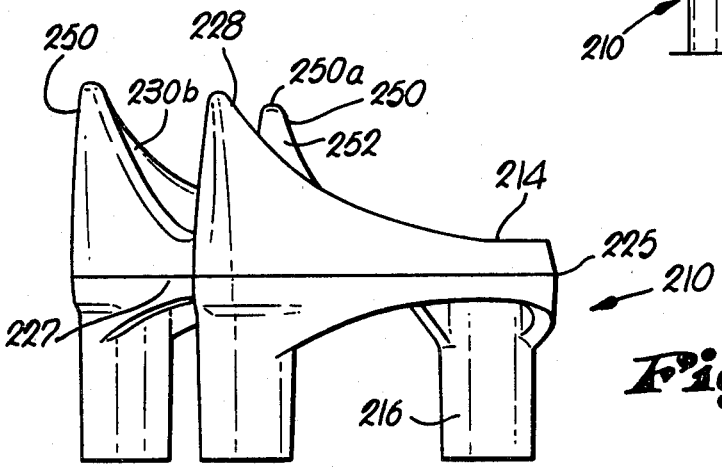
FIG. 14 is an elevational view from the right side of the tee of FIGS. 10–13.

Tee 210 differs from tees 10 and 110 primarily in the provision of a three-dimensionally triangular member 250 projecting upwardly from platform 214 in disposition and of a height to cooperate with elements 228 and 230 at the rearwardmost portion 227 of platform 214 in supporting a football 236 as best shown in FIG. 11. Member 250 is approximately 1¼ inches in height and therefore somewhat lesser in height than either of the elements 228 and 230. The inner triangular face 252 of member 250 is of concave configuration which merges smoothly with the upper face 254 of platform 214 and also with the adjacent concave surface **230*b*. Also as is best seen in FIGS. 10 and 14, the member 250 is slightly closer to the forwardmost portion 225 of platform 214 than element 228. Also the apex 250*a* of member 250 is located outboard of platform 214 a distance such that the lower conical end 236*a* of a football 236 is complementally cradled in the triangular support defined by elements 228 and 230 along with member 250 thereby stabilizing the ball against deflection until kicked by the kicker, even under windy conditions. This is especially important when the wind is blowing toward the right side of the tee 210 viewing FIGS. 10 and 12. Note is also to be taken of the fact that member 240, located in closer spaced relationship to the element 230 than the width of a kicker's foot (about 2 inches tip to tip in the preferred embodiment) and is strategically positioned such that it does not offer an impediment to the kicker's foot as the underside of the ball 236** is impacted by upper instep of the kicker's foot during soccer style kicking.

For ease of manufacture and to permit fabrication of a tee having a long useful life under varying climatic conditions and use factors, it is preferred, although not essential, to mold the unit in one piece of a thermoplastic synthetic resin material such as a urethane vinylacetate (UVA). When constructed of the dimensions previously delineated and of UVA, it has been found that the tee weighs about 5 oz. In order to increase the stability of the tee and assure that it is not deflected by the kicker's foot in any way which would cause the ball to follow an errant path, it has been found desirable to increase the weight of the tee by incorporating a metal weight in the front leg 216 of the tee 210. Such weight desirably is of the order of 0.9 to 1 oz.

I claim:

1. A tee for supporting a football to be kicked soccer style comprising:

an upwardly facing platform for receiving the toe of a football to be kicked;

means for supporting the platform in an elevated, generally horizontal position above the football field, said platform having a forwardmost portion when oriented for normal use by a soccer style kicker and a rear portion located rearwardly of said forwardmost portion; and structure projecting upwardly from the platform generally at said rear portion of the platform and of an effective height and located in dispostion to engage the sidewall of a football placed on the platform to thereby maintain the football in a desired upright position as it is approached and then impacted by the upper instep side of the kicker's foot in performing a soccer style kick, said structure including a pair of upstanding, upright elements projecting upwardly from the platform, spaced apart a distance less than the maximum width of the kicker's foot and located on opposite sides of the section of the platform upon which the toe of the football normally rests, means on said platform defining a forward-rearward axis for said platform, one of the elements being positioned in closer spaced relationship to said forwardmost portion of the platform than the other element whereby a straight line between said pair of elements will intersect said axis at an acute angle thereto, said one element being that element which is in closer proximal relationship to the kicker's toe when his foot is in normal instep impacting relationship to a football supported on said platform, than to the heel of the kicker's foot.

2. A tee as set forth in claim 1 wherein is provided an upstanding, upright member projecting upwardly from the platform at said rear portion thereof on the opposite side of the platform from said one element thereon and of a height to engage the sidewall of a football on the platform and stabilize such ball against deflection by wind currents blowing across the tee from the member toward the latter from said one element.

3. A tee as set forth in claim 2 wherein said member is of lesser height than the elements.

4. A tee as set forth in claim 3 wherein said one elements is of lesser height than the other element.

5. A tee as set forth in claim 2 wherein said platform is of essentially planar configuration and parallel to the ground in normal use of the tee.

6. A tee as set forth in claim 2 wherein said tee is molded of a synthetic resin material and weight means is incorporated in said platform support means adjacent the forwardmost portion of the platform.

7. A tee as set forth in claim 1 wherein the effective transverse dimension of each of the elements decreases as respective upper extremities are approached.

8. A tee as set forth in claim 7 wherein said elements are each of generally triangular three-dimensional shape and terminate in an upper apex.

9. A tee as set forth in claim 8 wherein the surface of each triangular element facing toward the platform is of generally concave triangular configuration.

10. A tee as set forth in claim 7 wherein the effective transverse dimesnion of the member decreases as the upper extremity thereof is approached.

11. A tee as set forth in claim 10 wherein said member is of generally triangular three-dimensional shape and also terminates in an upper apex.

12. A tee as set forth in claim 10 wherein the surface of the member facing toward the platform is of generally concave triangular configuration.

13. A tee as set forth in claim 12 wherein the lower portions of the concave surfaces of the member and the element in closest relative relationship thereto merge in a common smooth face segment.

14. A tee as set forth in claim 13 wherein said platform has a series of grooves in the surface thereof for increasing frictional contact of the toe of a football with the platform surface.

15. A tee as set forth in claim 1 wherein said member is slightly closer to the forwardmost portion of the platform than said one element.

16. A tee as set forth in claim 1 wherein said platform supporting means comprises a series of individual legs depending from the platform and adapted to rest on the turf of the football field.

17. A tee as set forth in claim 16 wherein three support legs are provided for the platform and located in triangle defining relative relationship.

18. A tee as set forth in claim 1 wherein said elements are located in dispositions on the platform such that an imaginary line between the elements is at an angle of from about 15° to about 35° relative to an imaginary fore and aft second line bisecting the platform and extending essentially parallel to the intended flight path of the ball when kicked from the platform by a kicker using a soccer style kicking technique.

19. A tee as set forth in claim 18 wherein said elements are disposed on the platform in positions causing said angle to be about 25°.

20. A tee as set forth in claim 18 wherein is provided direction defining surface indicia in the nature of an arrow lying on said imaginary fore and aft line of the platform and pointing toward the forwardmost portion of the same.

21. A tee as set forth in claim 1 wherein the rearmost surfaces of the elements are canted toward the forwardmost portion of the platform as the upper apices thereof are approached to minimize engagement of the upper instep of the kicker's foot with such elements.

* * * * *